US005387457A

United States Patent [19]

Sato

[11] Patent Number: 5,387,457

[45] Date of Patent: * Feb. 7, 1995

[54] ABRASIVE TAPE AND METHOD FOR POLISHING MAGNETIC HEADS

[75] Inventor: Masami Sato, Kanagawa, Japan

[73] Assignee: Fuji Photo Film Co., Ltd., Kanagawa, Japan

[ * ] Notice: The portion of the term of this patent subsequent to May 24, 2011 has been disclaimed.

[21] Appl. No.: 56,943

[22] Filed: May 5, 1993

Related U.S. Application Data

[63] Continuation of Ser. No. 814,807, Dec. 31, 1991, abandoned.

[30] Foreign Application Priority Data

Jan. 9, 1991 [JP] Japan ..... 3-001045

[51] Int. Cl.[6] ..... B32B 5/16; G11B 5/84

[52] U.S. Cl. ..... 428/141; 51/295; 51/309; 428/323; 428/328; 428/329; 428/694 R; 428/932; 451/533; 451/539

[58] Field of Search ..... 51/295, 309, 394, 401, 51/407; 428/323, 328, 329, 141, 694, 932

[56] References Cited

U.S. PATENT DOCUMENTS 4,756,960 7/1988 Yamaguchi et al. ..... 428/329
4,762,534 8/1988 Ito et al. ..... 51/293
4,842,618 6/1989 Ito et al. ..... 51/309
4,903,440 2/1990 Larson et al. ..... 51/293
4,922,675 5/1990 Sato et al. ..... 51/394

*Primary Examiner*—D. S. Nakarani
*Attorney, Agent, or Firm*—Sughrue, Mion, Zinn, Macpeak & Seas

[57] ABSTRACT

An abrasive tape comprises a flexible substrate and an abrasive layer which is overlaid on the flexible substrate and which contains abrasive grains and a binder. The abrasive grains comprise first abrasive grains, which have a mean grain diameter falling within the range of 0.07 μm to 0.40 μm and a Mohs hardness falling within the range of 5 to 7, second abrasive grains, which have a mean grain diameter falling within the range of 0.20 μm to 0.60 μm and a Mohs hardness not lower than 8.5, and fine diamond grains, which have a mean grain diameter falling within the range of 0.5 μm to 3.0 μm. The abrasive tape is used during a polishing process on a laminated type of magnetic head, which is constituted of a nonmagnetic substrate, a magnetic material, and a glass bonding agent. The abrasive tape is suitable for the polishing of magnetic heads, which are to be used for high-density recording with the shortest recording wavelengths of approximately 0.8 μm, and has a high polishing performance.

16 Claims, 2 Drawing Sheets

ABRASIVE TAPE AND METHOD FOR POLISHING MAGNETIC HEADS

This is a continuation of application No. 07/814,807 filed Dec. 31, 1991, now abandoned.

BACKGROUND OF THE INVENTION

1. Field of the Invention

This invention relates to an abrasive tape to be used for polishing of a magnetic head, or the like. This invention particularly relates to an abrasive tape to be used for finished polishing of a rough-polished surface of a magnetic head, or the like. This invention also relates to a method for polishing a magnetic head, wherein the abrasive tape is employed.

2. Description of the Prior Art

Video or high-grade audio magnetic heads are made by being polished with abrasive tapes. The abrasive tape comprises a flexible substrate, and an abrasive layer overlaid on the flexible substrate. In order for the abrasive layer to be provided, an abrasive composition containing abrasive grains, a binder, additives, and the like, is applied onto the flexible substrate and dried.

In general, when the surface of a magnetic head, or the like, is to be polished with the abrasive tape, two reels are positioned with the magnetic head, or the like, intervening therebetween. The abrasive tape is moved between the two reels while it is in contact with the surface to be polished. The abrasive tape is flexible and can snugly fit to a curved surface. Therefore, the abrasive tape is more suitable for the polishing of the curved surface of the magnetic head, or the like, than grinding wheels. Also, the abrasive tape can achieve scratch-free, accurate polishing of the surface to be polished, and is therefore indispensable to finish polishing of a rough-polished surface.

As is well known, polishing processes wherein the abrasive tape is used are carried out for the purposes of shaping the tip of a magnetic head into a desired form, eliminating the chipping of a magnetic head, and polishing the surface of a magnetic head to a smooth finish. In order for the polishing process to be performed in the most effective manner, it is required that the polishing performance be increased, the time required for the polishing be minimized, and that the smoothness of the polished surface be increased. In order for the polishing performance to be increased, an abrasive tape provided with hard, large-sized abrasive grains may be used. However, when the abrasive tape provided with hard, large-sized abrasive grains is used, the smoothness of the polished surface cannot be increased. On the contrary, in order for the smoothness of the polished surface to be increased, an abrasive tape provided with soft, small-sized abrasive grains may be used. However, the polishing performance of the abrasive tape provided with soft, small-sized abrasive grains is low. Therefore, various attempts have been made to provide an abrasive tape which would satisfy both of the incompatible requirements described above. For example, it has been proposed in Japanese Unexamined Patent Publication No. 54(1979)–97408 to employ two types of abrasive grains as the abrasive grains contained in the abrasive layer of an abrasive tape, thereby to increase both the polishing performance of the abrasive tape and the smoothness of a polished surface.

In recent years, information is recorded at an increasingly higher density on magnetic recording media, such as video tapes, and therefore magnetic heads are required to exhibit better recording characteristics. For example, the shortest recording wavelength was approximately 1 μm for conventional video tapes, and is as short as 0.8 μm for the S-VHS system video tapes (such as S-MASTER supplied by Fuji Photo Film Co., Ltd. and 5516XTS supplied by Sumitomo 3M Ltd.). As the recording wavelengths are shortened, it is required to improve the characteristics of the magnetic heads. However, the abrasive tape proposed in, for example, Japanese Unexamined Patent Publication No. 54(1979)–97408 is designed to polish magnetic heads to be used with recording wavelengths of approximately 1 μm, and is not suitable for the polishing of magnetic heads which are recently required to exhibit better recording characteristics.

Also, recently, structures and materials of video heads are markedly varied from those of conventional ferrite video heads. For example, VTR NV-FS900 supplied by Matsushita Electric Industrial Co., Ltd. is provided with a laminated type of amorphous head, which is constituted of a combination of a ceramic material, an amorphous material, and a glass material. VTR CCD-TR55 supplied by Sony Corp. is provided with a MIG head, which is constituted of a combination of a ferrite material, a Sendust material, and a glass material. Also, VTR VTS625 supplied by Hitachi, Ltd. is provided with an amorphous head, which is constituted of a combination of a ferrite material, an amorphous material, and a glass material and which has a cross shape. Such video heads have compound structures in which materials having markedly different hardnesses are located adjacent to one another. Abrasive tapes used for the finish polishing of such video heads must be capable of polishing the video heads uniformly such that no difference in level such as a step at a boundary between a soft material and a hard material. A difference in level, which occurs between different materials, has various adverse effects. In particular, if a difference in level occurs at a video head gap part for magnetically carrying out signal recording and reproduction, the magnetic recording and reproducing characteristics of the video head will deteriorate. In high-performance video heads which are supplied recently, soft metals are used at the video head gap parts. Therefore, during the polishing operation, the video head gap part is worn more easily than the surrounding substrate parts, and a concave difference in level thereby occurs. Accordingly, space loss occurs, and the input-output transfer characteristics of the magnetic recording deteriorate.

SUMMARY OF THE INVENTION

The primary object of the present invention is to provide an abrasive tape which is suitable for the polishing of magnetic heads to be used for high-density recording with the shortest recording wavelengths of approximately 0.8 μm.

Another object of the present invention is to provide an abrasive tape which has a high polishing performance.

The specific object of the present invention is to provide a method for polishing a magnetic head which is suitable for the polishing of magnetic heads to be used for high-density recording with the shortest recording wavelengths of approximately 0.8 μm and with which a high polishing performance is obtained.

The inventors studied various compositions of abrasive layers of abrasive tapes, and found that the aforesaid objects are accomplished when the grain size and the hardness of abrasive grains contained in an abrasive layer are adjusted to values falling within specific ranges.

Specifically, the present invention provides an abrasive tape comprising a flexible substrate and an abrasive layer which is overlaid on the flexible substrate and which contains abrasive grains and a binder, wherein the abrasive grains comprise:

i) first abrasive grains, which have a mean grain diameter falling within the range of 0.07 μm to 0.40 μm and a Mohs hardness falling within the range of 5 to 7, ii) second abrasive grains, which have a mean grain diameter falling within the range of 0.20 μm to 0.60 μm and a Mohs hardness not lower than 8.5, and iii) fine diamond grains, which have a mean grain diameter falling within the range of 0.5 μm to 3.0μm.

In the abrasive tape in accordance with the present invention, the proportion of the weight of the fine diamond grains with respect to the total weight of the first abrasive grains and the second abrasive grains should preferably fall within the range of 1% to 3%.

The present invention also provides a method for polishing a magnetic head, which comprises the steps of using the abrasive tape in accordance with the present invention during a finished polishing process on a video head constituted of a composite material whose constituent materials have markedly different hardnesses, in particular, on a laminated type of video head constituted of a non-magnetic substrate material, such as a ceramic material, a magnetic material, such as an amorphous alloy, and a glass bonding agent, or on a composite type of magnetic head, such as a combination head composed of a laminated type of video head and a ferrite head.

With the abrasive tape and the method for polishing a magnetic head in accordance with the present invention, a high polishing performance can be obtained. Therefore, a finished polishing process can be carried out quickly on a video head constituted of a composite material whose constituent materials have markedly different hardnesses, in particular, on a laminated type amorphous alloy video head. Also, the difference in level between materials having different hardnesses can be kept small. Additionally, the surface of a video head can be polished such that no deep scratches may occur on the polished surface. Accordingly, the finished polishing process on a high-density recording video head can be carried out in an effective manner.

By way of example, when the abrasive tape in accordance with the present invention is used during a finished polishing process on a laminated type of video head, which is constituted of a ceramic material, an amorphous alloy material, and a glass material, a large depth of polishing can be achieved. Also, a uniform polished surface can be obtained such that no difference in level may occur at boundaries between parts of the video head having different hardnesses, i.e. at the boundary between the ceramic part and the amorphous alloy part and at the boundary between the ceramic part and the glass part. Additionally, the surface of the laminated type of video head, which has been polished with the abrasive tape in accordance with the present invention, exhibits good smoothness and therefore is suitable for high-density recording.

How the effects of the abrasive tape and the method for polishing a magnetic head in accordance with the present invention are obtained will be described hereinbelow. Specifically, the fine diamond grains, which have a mean grain diameter falling within the range of 0.5 μm to 3.0 μm, turn the surface of the hard ceramic part of the video head. The second abrasive grains, which have a mean grain diameter falling within the range of 0.20 μm to 0.60 μm and a Mohs hardness not lower than 8.5, scrape the hard-ceramic part which has been turned and polish the surface of the hard ceramic part to a comparatively smooth finish. Also, the first abrasive grains, which have a mean grain diameter falling within the range of 0.07 μm to 0.40 μm and a Mohs hardness falling within the range of 5 to 7, further polish the surface, which is to be polished, to a smooth finish. In this manner, a large depth of polishing can be achieved, and a polished surface having good smoothness can be obtained. Additionally, the first abrasive grains, which basically provide a small grinding force, prevent a difference in level from occurring at the boundary between the ceramic part and the amorphous alloy part of the video head and at the boundary between the ceramic part and the glass part of the video head. Specifically, the first abrasive grains exert a small grinding force upon each of the ceramic part, the amorphous alloy part, and the glass part of the video head. Therefore, the difference in the depth of polishing between the three parts is kept very small.

The mean grain diameter of the first abrasive grains should preferably be within the range of 0.07 μm to 0.15 μm, and should more preferably be within the range of 0.10 μm to 0.13 μm. The mean grain diameter of the second abrasive grains should preferably be within the range of 0.20 μm to 0.40 μm, and should more preferably be within the range of 0.30 μm to 0.40 μm. The mean grain diameter of the fine diamond grains should preferably be within the range of 0.5 μm to 2.0 μm.

The proportion of the weight of the first abrasive grains with respect to the total weight of the whole abrasive grains should preferably be within the range of 60% to 80%. The proportion of the weight of the second abrasive grains with respect to the total weight of the whole abrasive grains should preferably be within the range of 20% to 30%. The proportion of the weight of the fine diamond grains with respect to the total weight of the whole abrasive grains should preferably be within the range of 1% to 3%. In such cases, the depth of polishing of the laminated type of video head can be kept large, and the surface of the laminated type of video head can be polished to a very smooth finish. Also, the polishing operation can be carried out such that the difference in level at the boundary between the ceramic part and the amorphous alloy part and at the boundary between the ceramic part and the glass part of the video head may be kept very small.

Also, the ratio of the standard deviation of the distribution of grain size of the first abrasive grains to the standard deviation of the distribution of grain size distribution of the second abrasive grains should preferably be approximately 1:2. For example, in cases where the mean grain diameters of the first abrasive grains and the second abrasive grains are 0.11 μm and 0.33 μm, respectively, the value of the standard deviation s which is determined from the grain size distribution on the basis of TEM images should preferably be approximately 0.06 μmm for the first abrasive grains and approximately 0.14 μm for the second abrasive grains.

If the proportion of the weight of the first abrasive grains with respect to the total weight of the whole abrasive grains is lower than the range described above, the smoothness of the polished surface of the laminated type of video head will deteriorate, and a large difference in level will occur at the boundaries between the parts of the video head comprising different materials. If the proportion of the weight of the first abrasive grains with respect to the total weight of the whole abrasive grains is higher than the range described above, the depth of polishing of the laminated type of video head will be decreased such that a long time will be required for the polishing operation to be completed during the manufacturing process, and therefore the productivity will be diminished. If the proportion of the weight of the second abrasive grains with respect to the total weight of the whole abrasive grains is lower than the range described above, the depth of polishing of the laminated type of video head will be decreased. Also, if the proportion of the weight of the second abrasive grains with respect to the total weight of the whole abrasive grains is higher than the range described above, the smoothness of the polished surface of the laminated type of video head will deteriorate. If the proportion of the weight of the fine diamond grains with respect to the total weight of the whole abrasive grains is lower than the range described above, the depth of polishing of the laminated type of video head will be decreased. Also, if the proportion of the weight of the fine diamond grains with respect to the total weight of the whole abrasive grains is higher than the range described above, the smoothness of the polished surface of the laminated type of video head will deteriorate.

The first abrasive grains may be formed of $\alpha$-$Fe_2O_3$, $TiO_2$, $SiO_2$, $SnO_2$, or the like. The second abrasive grains may be formed of $Cr_2O_3$, $Al_2O_3$, SiC, or the like. The fine diamond grains may be constituted of synthetic diamond, reprocessed diamond, or the like. The proportion of the total weight of the first abrasive grains, the second abrasive grains, and the fine diamond grains with respect to the weight of total solids, which are contained in the abrasive layer comprising the abrasive grains and the binder, should preferably be within the range of 80% to 95%, and should more preferably be within the range of 90% to 95%. If the proportion is lower than 80%, a good polishing performance of the abrasive tape cannot be obtained. If said proportion is higher than 95%, the abrasive grains will readily separate from the abrasive layer, and the polished surface will be detrimentally scratched by the separated abrasive grains. Also, the surface roughness (Ra) of the abrasive layer should preferably be within the range of 0.046 $\mu$m to 0.130 $\mu$m.

DESCRIPTION OF THE PREFERRED EMBODIMENTS

The present invention will hereinbelow be described in further detail with reference to the accompanying drawings.

Figure 2:
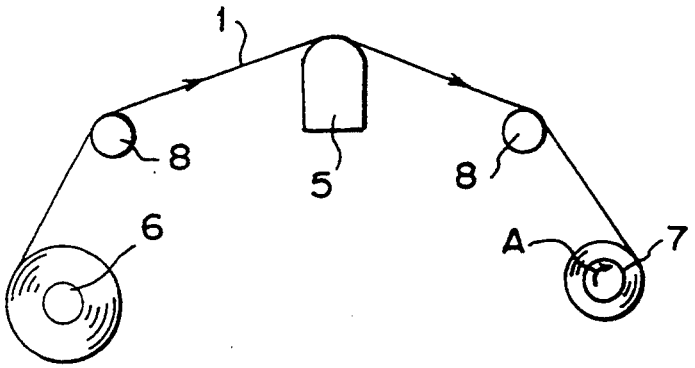
FIG. 2 is a schematic view showing an example of the polishing apparatus wherein the abrasive tape of FIG. 1 is employed.

FIG. 2 is a schematic view showing an example of the polishing apparatus wherein an embodiment of the abrasive tape in accordance with the present invention is employed.

Figure 1:
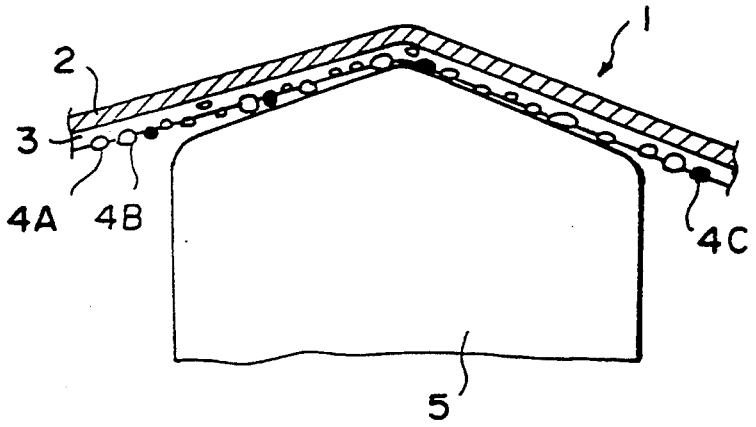
FIG. 1 is an explanatory view showing an embodiment of the abrasive tape in accordance with the present invention and a magnetic head to be polished.

With reference to FIG. 2, a tape wind-up reel 7 is rotated in the direction indicated by the arrow A, and an abrasive tape 1 is fed from a tape feed roll 6 in the direction indicated by the arrow. The abrasive tape 1 is threaded over pass rolls 8, 8 so that it is contacted at a predetermined lap angle with a magnetic head 5 which is to be polished. In this manner, the surface of the magnetic head 5 on which the abrasive tape 1 slides is polished by the abrasive tape 1. As shown in FIG. 1, the abrasive tape 1 comprises a flexible non-magnetic substrate 2, which may be constituted of polyethylene terephthalate (PET), polyethylene-2,6-naphthalate or the like, and an abrasive layer 3 overlaid on the flexible non-magnetic substrate 2. The abrasive layer 3 slides on the magnetic head 5 to perform the polishing process. The abrasive layer 3 comprises first abrasive grains 4A having a comparatively low hardness and comparatively small diameters, second abrasive grains 4B having a comparatively high hardness and comparatively large diameters, fine diamond grains 4C having a high hardness, and a binder or the like, which have been kneaded together and applied onto the flexible non-magnetic substrate 2. The first abrasive grains 4A have a mean grain diameter falling within the range of 0.07 $\mu$m to 0.40 $\mu$m and a Mohs hardness falling within the range of 5 to 7. The second abrasive grains 4B have a mean grain diameter falling within the range of 0.20 $\mu$m to 0.60 $\mu$m and a Mohs hardness not lower than 8.5. The fine diamond grains have a mean grain diameter falling within the range of 0.5 $\mu$m to 3.0 $\mu$m. The binder should have good dispersing quality in order to substantially disperse the first abrasive grains, the second abrasive grains, and the fine diamond grains in the abrasive layer 3 and adhere them to the abrasive layer 3. Also, additives such as a lubricant should preferably be added to the abrasive layer 3 so that the abrasive layer 3 moves easily with respect to the magnetic head 5. Preferable thicknesses of the abrasive layer 3 and the flexible non-magnetic substrate 2 vary depending on the shape of the magnetic head 5 to be polished. In cases where the abrasive tape 1 is to be used for finished polishing of an S-VHS system magnetic head, the thickness of the abrasive layer 3 should preferably be approximately 5 $\mu$m when the thickness of the flexible non-magnetic substrate 2 is 30 $\mu$m. Also, the thickness of the abrasive layer 3 should preferably be approximately 10 $\mu$m when the thickness of the flexible non-magnetic substrate 2 is 23 $\mu$m. If the thickness of the abrasive layer 3 is excessively large, the abrasive tape 1 cannot snugly fit to the magnetic head 5. Therefore, the thickness of the abrasive layer 3 should preferably be not larger than 50 $\mu$m.

Particularly, in the abrasive tape and the method for polishing a magnetic head in accordance with the present invention, the thickness of the abrasive layer after being dried should preferably be not larger than the mean grain diameter of the fine diamond grains. As described above, the mean grain diameter of the fine diamond grains is larger than the mean grain diameters of the first abrasive grains and the second abrasive grains. Therefore, in cases where the thickness of the abrasive layer after being dried is not larger than the mean grain diameter of the fine diamond grains, the fine diamond grains predominantly appear on or project from the surface of the abrasive layer. As a result, even if the amount of the fine diamond grains contained in the abrasive layer is small, the fine diamond grains can work efficiently.

Figure 3:
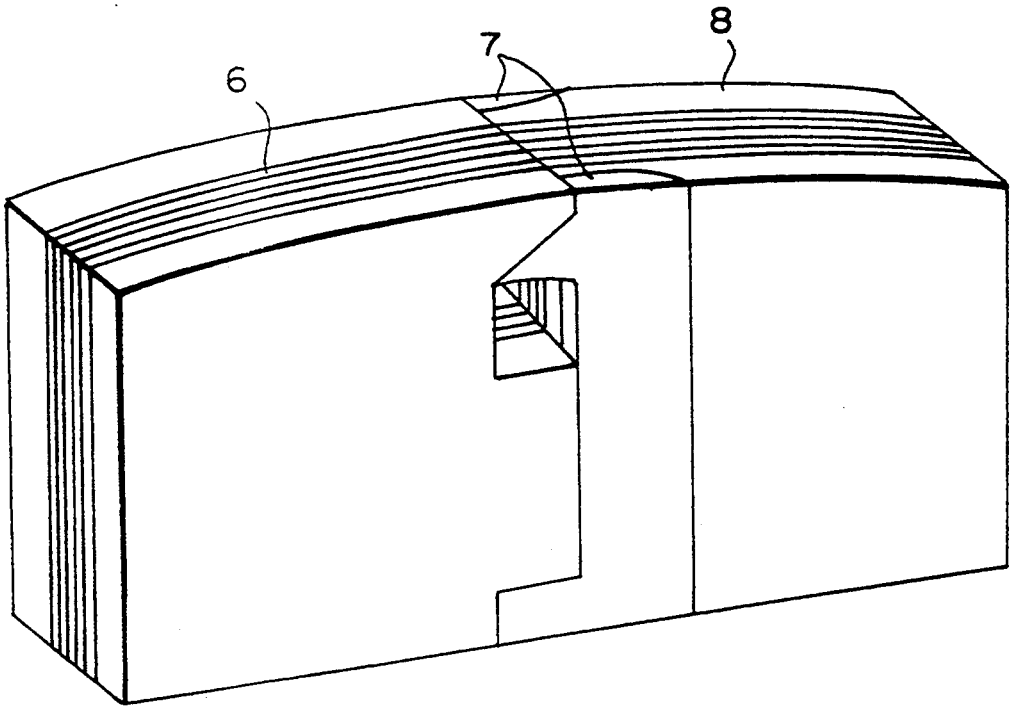
FIG. 3 is a schematic perspective view showing a laminated type of amorphous alloy video head, which is to be polished with the abrasive tape of FIG. 1.

FIG. 3 schematically shows a laminated type of video head, which is constituted of a ceramic material, an amorphous alloy material, and a glass material. The materials constituting such a video head have markedly different hardnesses. Therefore, when a conventional abrasive tape is used to polish such a video head, a large depth of polishing cannot be achieved, and a large difference in level occurs at the boundaries between the materials. The abrasive tape in accordance with the present invention solves such problems. In FIG. 3, a laminated amorphous alloy part 6 is sandwiched between ceramic parts (non-magnetic substrates) 8, 8, and glass parts 7, 7 having a low melting point are fitted to the ceramic parts 8, 8.

Figure 4:
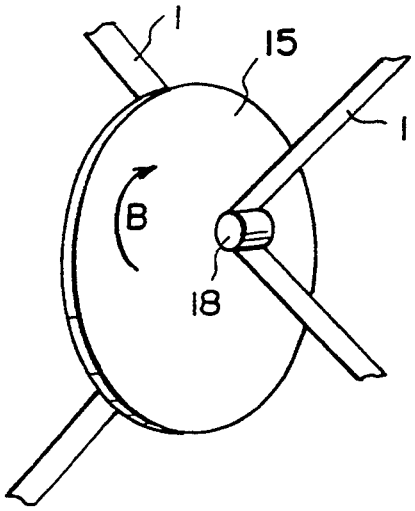
FIG. 4 is a schematic perspective view showing an example of the polishing apparatus different from that of FIG. 2, wherein the abrasive tape of FIG. 1 is employed.
Figure 5:
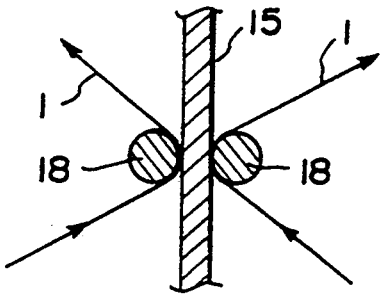
FIG. 5 is a sectional side view of the polishing apparatus shown in FIG. 4.

The abrasive tape 1 in accordance with the present invention is suitable particularly for the polishing of a magnetic head requiring high performance characteristics. However, the abrasive tape 1 in accordance with the present invention may also be used for polishing a hard disk 15 in the manner shown in FIGS. 4 and 5. In cases where the hard disk 15 is to be polished, it is sandwiched between rubber rollers 18, 18, and the abrasive layers of the abrasive tapes 1, 1 are pushed by the rubber rollers 18, 18 against both surfaces of the hard disk 15. The hard disk 15 is then rotated in the direction indicated by the arrow B so that both surfaces of the hard disk 15 are polished simultaneously. In this case, a pushing force larger than the pushing force exerted to the magnetic head 1 shown in FIGS. 1 and 2 is applied to the hard disk 15 which is to be polished. However, since each of the abrasive tapes 1, 1 in accordance with the present invention is provided with three types of the abrasive grains as described above, there is no risk of the hard disk 15 being scratched detrimentally.

The present invention will further be illustrated by the following non-limitative examples. In these examples, abrasive tapes were made under different conditions described below. The term "parts" as used hereinbelow means parts by weight of solids.

EXAMPLE 1

An abrasive coating composition as shown below was applied to a thickness of 5 μm onto a 23 μm-thick polyethylene terephthalate (PET) substrate, and dried to form an abrasive layer. The substrate on which the abrasive layer had been overlaid was slit to a width of ½ inch, and an abrasive tape was thereby made.

Abrasive coating composition:

| | |
|---|---|
| $\alpha$-$Fe_2O_3$ abrasive grains (first abrasive grains) (granular, mean grain diameter: 0.11 μm, Mohs hardness: 5.0) | 225 parts |
| $Cr_2O_3$ abrasive grains (second abrasive grains) (granular, mean grain diameter: 0.30 μm, Mohs hardness: 8.5) | 75 parts |
| Fine diamond grains (granular, mean grain diameter: 1.0 μm, Mohs hardness: 10.0) | 9 parts |
| Vinyl chloride resin (Vinyl chloride having an average molecular weight of $2.6 \times 10^4$: 87 wt %, epoxy group content: 3.5 wt %, sodium sulfonate group content: 0.5 wt %, where wt % is a value with respect to the weight of the vinyl chloride resin) | 8.3 parts |
| Sulfonic acid group-containing polyurethane resin (molecular weight: 25,000, molecular weight per —$SO_3H$: 25,000) | 4.8 parts |
| Polyisocyanate (75 wt % ethyl acetate solution of a reaction product of 3 mols of 2,4-tolylene diisocyanate compound with 1 mol of trimethylolpropane) | 9.6 parts |
| $C_{16}H_{33}O(CH_2CH_2O)_{10}H$ (Emulex 110 supplied by Nippon Emulsion K.K. | 2.9 parts |
| Methyl ethyl ketone | 110 parts |
| Cyclohexanone | 100 parts |

EXAMPLE 2

An abrasive tape was made under the same conditions as those in Example 1, except that $SiO_2$ abrasive grains (granular, mean grain diameter: 0.11 μm, Mohs hardness: 7.0) were used as the first abrasive grains.

EXAMPLE 3

An abrasive tape was made under the same conditions as those in Example 1, except that $Al_2O_3$ abrasive grains (granular, mean grain diameter: 0.30 μm, Mohs hardness: 9.0) were used as the second abrasive grains.

EXAMPLE 4

An abrasive tape was made under the same conditions as those in Example 1, except that $\alpha$-$Fe_2O_3$ abrasive grains (granular, mean grain diameter: 0.07 μm, Mohs hardness: 5.0) were used as the first abrasive grains.

EXAMPLE 5

An abrasive tape was made under the same conditions as those in Example 1, except that $\alpha$-$Fe_2O_3$ abrasive grains (granular, mean grain diameter: 0.40 μm, Mohs hardness: 5.0) were used as the first abrasive grains.

EXAMPLE 6

An abrasive tape was made under the same conditions as those in Example 1, except that $Cr_2O_3$ abrasive grains (granular, mean grain diameter: 0.20 μm, Mohs hardness: 8.5) were used as the second abrasive grains.

EXAMPLE 7

An abrasive tape was made under the same conditions as those in Example 1, except that $Cr_2O_3$ abrasive grains (granular, mean grain diameter: 0.60 μm, Mohs hardness: 8.5) were used as the second abrasive grains.

EXAMPLE 8

An abrasive tape was made under the same conditions as those in Example 1, except that fine diamond grains having a mean grain diameter of 0.5 μm (Mohs hardness: 10) were used as the fine diamond grains.

EXAMPLE 9

An abrasive tape was made under the same conditions as those in Example 1, except that fine diamond grains having a mean grain diameter of 3.0 μm (Mohs hardness: 10) were used as the fine diamond grains.

COMPARATIVE EXAMPLE 1

An abrasive tape was made under the same conditions as those in Example 1, except that $\alpha$-$Fe_2O_3$ abrasive grains (granular, mean grain diameter: 0.30 μm, Mohs hardness: 5.0) were used as the first abrasive grains.

COMPARATIVE EXAMPLE 2

An abrasive tape was made under the same conditions as those in Example 1, except that $\alpha$-$Fe_2O_3$ abrasive grains (granular, mean grain diameter: 0.80 μm, Mohs hardness: 5.0) were used as the first abrasive grains.

COMPARATIVE EXAMPLE 3

An abrasive tape was made under the same conditions as those in Example 1, except that $Cr_2O_3$ abrasive grains (granular, mean grain diameter: 0.08 μm, Mohs hardness: 8.5) were used as the second abrasive grains.

COMPARATIVE EXAMPLE 4

An abrasive tape was made under the same conditions as those in Example 1, except that $Cr_2O_3$ abrasive grains (granular, mean grain diameter: 0.80 μm, Mohs hardness: 8.5) were used as the second abrasive grains.

COMPARATIVE EXAMPLE 5

An abrasive tape was made under the same conditions as those in Example 1, except that the fine diamond grains were not used.

COMPARATIVE EXAMPLE 6

An abrasive tape was made under the same conditions as those in Example 1, except that fine diamond grains having a mean grain diameter of 0.2 μm (Mohs hardness: 10) were used as the fine diamond grains.

COMPARATIVE EXAMPLE 7

An abrasive tape was made under the same conditions as those in Example 1, except that fine diamond grains having a mean grain diameter of 5.0 μm (Mohs hardness: 10) were used as the fine diamond grains.

COMPARATIVE EXAMPLE 8

An abrasive tape was made under the same conditions as those in Example 1, except that the amount of the fine diamond grains used was changed to 3 parts.

COMPARATIVE EXAMPLE 9

An abrasive tape was made under the same conditions as those in Example 1, except that the amount of the fine diamond grains used was changed to 1.5 parts.

COMPARATIVE EXAMPLE 10

An abrasive tape was made under the same conditions as those in Example 1, except that the amount of the fine diamond grains used was changed to 15 parts.

COMPARATIVE EXAMPLE 11

An abrasive tape was made under the same conditions as those in Example 1, except that the amount of the first abrasive grains used was changed to 0 parts, and the amount of the second abrasive grains used was changed to 300 parts.

COMPARATIVE EXAMPLE 12

An abrasive tape was made under the same conditions as those in Example 1, except that the amount of the first abrasive grains used was changed to 300 parts, and the amount of the second abrasive grains used was changed to 0 parts.

COMPARATIVE EXAMPLE 13

An abrasive tape was made under the same conditions as those in Example 1, except that the amount of the first abrasive grains used was changed to 0 parts, and 300 parts of $Al_2O_3$ abrasive grains (granular, mean grain diameter: 2.0 μm, Mohs hardness: 9) were used as the second abrasive grains.

Table 1 shows the abrasive grain compositions of the abrasive tapes, which were made by Examples 1 through 9 and Comparative Examples 1 through 13, and the results evaluating the finished polishing characteristics of these abrasive tapes with respect to laminated types of amorphous video heads. In order for the polishing characteristics of these abrasive tapes with respect to laminated types of amorphous video heads to be evaluated, each of the abrasive tapes made by Examples 1 through 9 and Comparative Examples 1 through 13 were set in a polishing apparatus and used during a finished polishing operation on a laminated type of amorphous video head, which had been subjected to rough polishing and intermediate polishing. After the finished polishing operation on the laminated type of amorphous video head was carried out with each abrasive tape, the number of scratches having a width of at least 0.5 μm, which occurred on the surface of the laminated type of amorphous video head, was counted. Also, the difference in level between different materials constituting the laminated type of amorphous video head was measured. Additionally, the time required to polish the laminated type of amorphous video head by a depth of 1 μm was counted. The evaluation of the polishing characteristics of the abrasive tapes with respect to laminated types of video heads was carried out under the same conditions in the tests on all abrasive tapes. The number of scratches having a width of at least 0.5 μm, which occurred on the surface of the laminated type of amorphous video head, was counted by investigating the surface of the laminated type of amorphous video head with a microscope. In order for the difference in level between different materials constituting the laminated type of amorphous video head to be measured, the surface roughness of the laminated type of amorphous video head was measured with a surface texture measuring instrument at a cut-off value of 0.8 mm, a stylus radius of 2 micron R and a stylus speed of 0.3 mm/sec. The time required to polish the laminated type of amorphous video head by a depth of 1 μm was used to evaluate the grinding force of each abrasive tape.

As for the results of overall evaluation, the "O" mark indicates that both the productivity and the polishing quality were good. The "Δ" mark indicates that the productivity and the polishing quality were not so good, but were practically allowable. The "x" mark indicates that the productivity and/or the polishing quality was bad.

As will be clear from Table 1, with the abrasive tapes made by Examples 1 through 9, the number of scratches occurring on the surface of the laminated type of amorphous video head is comparatively small. Also, the difference in level between the different materials comprising the laminated type of amorphous video head is comparatively small. Additionally, the time required to polish the laminated type of amorphous video head by a depth of 1 μm was comparatively short. Thus it was confirmed that the abrasive tapes made by Examples 1 through 9 have good polishing characteristics.

From the results obtained with the abrasive tapes made by Examples 1, 4, and 5 and Comparative Examples 1 and 2, it was revealed that the mean grain diameter of the first abrasive grains should fall within the range of 0.07 μm to 0.40 μm. It is considered that, if the mean grain diameter of the first abrasive grains is smaller than 0.07 μm, the grinding force becomes markedly small, and therefore the performance for eliminating a difference in level between the different materials comprising the laminated type of amorphous video head is lost. If the mean grain diameter of the first abrasive grains is larger than 0.40 μm, the soft amorphous alloy part and the glass part having a low melting point become scratched deeply.

From the results obtained with the abrasive tapes made by Examples 1, 6, and 7 and Comparative Examples 3 and 4, it was revealed that the mean grain diameter of the second abrasive grains should fall within the range of 0.20 μm to 0.60 μm. It is considered that, if the mean grain diameter of the second abrasive grains is smaller than 0.20 μm, the grinding force is decreased, and therefore a long time is required to polish the laminated type of amorphous video head by a depth of 1 μm. Accordingly, productivity cannot be maximized. If the mean grain diameter of the second abrasive grains is larger than 0.60 μm, the soft amorphous alloy part and the glass part having a low melting point become scratched deeply.

From the results obtained with the abrasive tapes made by Example 1 and Comparative Example 5, it was revealed that, if the amount of fine diamond grains used is equal to O parts, the effects of turning the hard ceramic part of the video head become unacceptable. As a result, a long time is required to polish the laminated type of amorphous video head by a depth of 1 μm, and productivity is minimized.

From the results obtained with the abrasive tapes made by Examples 1, 8, and 9 and Comparative Examples 6 and 7, it was revealed that the mean grain diameter of the fine diamond grains should fall within the range of 0.5 μm to 3.0 μm. It is considered that, if the mean grain diameter of the fine diamond grains is smaller than 0.5 μm, the effects of turning the ceramic part of the video head become unacceptable, and therefore a long time is required to polish the laminated type of amorphous video head by a depth of 1 μm. If the mean grain diameter of the fine diamond grains is larger than 3.0 μm, the soft amorphous alloy part and the glass part having a low melting point become scratched deeply.

From the results obtained with the abrasive tapes made by Example 1 and Comparative Examples 8, 9 and 10, it was revealed that the proportion of the fine diamond grains to the total weight of the first abrasive grains and the second abrasive grains should fall within the range of 1% by weight to 3% by weight. If the proportion of the fine diamond grains to the total weight of the first abrasive grains and the second abrasive grains is lower than 1% by weight, a long time is required to polish the laminated type of amorphous video head by a depth of 1 ∞m. Therefore, the productivity is minimized. If the proportion of the fine diamond grains to the total weight of the first abrasive grains and the second abrasive grains is higher than 3% by weight, the soft amorphous alloy part and the glass part having a low melting point become scratched deeply. Therefore, the recording characteristics of the video head become unacceptable.

From the results obtained with the abrasive tapes made by Example 1 and Comparative Example 11, it was revealed that, if the first abrasive grains are omitted, the amorphous alloy part and the glass part having a low melting point become scratched deeply. Also, a large difference in level occurs between the different materials comprising the laminated type of amorphous video head. Thus problems occur in practice.

From the results obtained with the abrasive tapes made by Example 1 and Comparative Example 12, it was revealed that, if the second abrasive grains are omitted, a long time is required to polish the laminated type of amorphous video head by a depth of 1 μm. Therefore, the productivity is minimized.

From the results obtained with the abrasive tapes made by Example 1 and Comparative Example 13, it was revealed that, if the first abrasive grains are omitted, and the mean grain diameter of the second abrasive grains goes beyond the range defined in the present invention, the hard ceramic part of the video head becomes scratched deeply. Also, because of the absence of the first abrasive grains, a large difference in level occurs between the different materials comprising the laminated type of amorphous video head.

The difference in level between the ceramic part and the amorphous alloy part occurs such that the amorphous alloy part becomes concave. The difference in level between the ceramic part and the glass part having a low melting point occurs such that the glass part having a low melting point becomes concave.

TABLE 1

| | Abrasive grain composition | | | | | | | | | | |
|---|---|---|---|---|---|---|---|---|---|---|---|
| | First abrasive grains | | | | Second abrasive grains | | | | Fine diamond grains | | |
| | Material | Mean grain dia. (μm) | Mohs hardness | Content (parts by weight) | Material | Mean grain dia. (μm) | Mohs hardness | Content (parts by weight) | Mean grain dia. (μm) | Mohs hardness | Content (parts by weight |
| Ex. 1 | $\alpha$-$Fe_2O_3$ | 0.11 | 5.0 | 225 | $Cr_2O_3$ | 0.30 | 8.5 | 75 | 1.0 | 10.0 | 9 |
| Ex. 2 | $SiO_2$ | 0.11 | 7.0 | 225 | $Cr_2O_3$ | 0.30 | 8.5 | 75 | 1.0 | 10.0 | 9 |
| Ex. 3 | $\alpha$-$Fe_2O_3$ | 0.11 | 5.0 | 225 | $Al_2O_3$ | 0.30 | 9.0 | 75 | 1.0 | 10.0 | 9 |
| Ex. 4 | $\alpha$-$Fe_2O_3$ | 0.07 | 5.0 | 225 | $Cr_2O_3$ | 0.30 | 8.5 | 75 | 1.0 | 10.0 | 9 |
| Ex. 5 | $\alpha$-$Fe_2O_3$ | 0.40 | 5.0 | 225 | $Cr_2O_3$ | 0.30 | 8.5 | 75 | 1.0 | 10.0 | 9 |
| Ex. 6 | $\alpha$-$Fe_2O_3$ | 0.11 | 5.0 | 225 | $Cr_2O_3$ | 0.20 | 8.5 | 75 | 1.0 | 10.0 | 9 |
| Ex. 7 | $\alpha$-$Fe_2O_3$ | 0.11 | 5.0 | 225 | $Cr_2O_3$ | 0.60 | 8.5 | 75 | 1.0 | 10.0 | 9 |
| Ex. 8 | $\alpha$-$Fe_2O_3$ | 0.11 | 5.0 | 225 | $Cr_2O_3$ | 0.30 | 8.5 | 75 | 0.5 | 10.0 | 9 |
| Ex. 9 | $\alpha$-$Fe_2O_3$ | 0.11 | 5.0 | 225 | $Cr_2O_3$ | 0.30 | 8.5 | 75 | 3.0 | 10.0 | 9 |
| Comp. Ex. 1 | $\alpha$-$Fe_2O_3$ | 0.03 | 5.0 | 225 | $Cr_2O_3$ | 0.30 | 8.5 | 75 | 1.0 | 10.0 | 9 |
| Comp. Ex. 2 | $\alpha$-$Fe_2O_3$ | 0.80 | 5.0 | 225 | $Cr_2O_3$ | 0.30 | 8.5 | 75 | 1.0 | 10.0 | 9 |

TABLE 1-continued

| | | | | | | | | | | | |
|---|---|---|---|---|---|---|---|---|---|---|---|
| Comp. Ex. 3 | $\alpha$-$Fe_2O_3$ | 0.11 | 5.0 | 225 | $Cr_2O_3$ | 0.08 | 8.5 | 75 | 1.0 | 10.0 | 9 |
| Comp. Ex. 4 | $\alpha$-$Fe_2O_3$ | 0.11 | 5.0 | 225 | $Cr_2O_3$ | 0.80 | 8.5 | 75 | 1.0 | 10.0 | 9 |
| Comp. Ex. 5 | $\alpha$-$Fe_2O_3$ | 0.11 | 5.0 | 225 | $Cr_2O_3$ | 0.30 | 8.5 | 75 | — | — | — |
| Comp. Ex. 6 | $\alpha$-$Fe_2O_3$ | 0.11 | 5.0 | 225 | $Cr_2O_3$ | 0.30 | 8.5 | 75 | 0.2 | 10.0 | 9 |
| Comp. Ex. 7 | $\alpha$-$Fe_2O_3$ | 0.11 | 5.0 | 225 | $Cr_2O_3$ | 0.30 | 8.5 | 75 | 5.0 | 10.0 | 9 |
| Comp. Ex. 8 | $\alpha$-$Fe_2O_3$ | 0.11 | 5.0 | 225 | $Cr_2O_3$ | 0.30 | 8.5 | 75 | 1.0 | 10.0 | 3 |
| Comp. Ex. 9 | $\alpha$-$Fe_2O_3$ | 0.11 | 5.0 | 225 | $Cr_2O_3$ | 0.30 | 8.5 | 75 | 1.0 | 10.0 | 1.5 |
| Comp. Ex. 10 | $\alpha$-$Fe_2O_3$ | 0.11 | 5.0 | 225 | $Cr_2O_3$ | 0.30 | 8.5 | 75 | 1.0 | 10.0 | 15 |
| Comp. Ex. 11 | — | — | — | — | $Cr_2O_3$ | 0.30 | 8.5 | 300 | 1.0 | 10.0 | 9 |
| Comp. Ex. 12 | $\alpha$-$Fe_2O_3$ | 0.11 | 5.0 | 300 | — | — | — | — | 1.0 | 10.0 | 9 |
| Comp. Ex. 13 | — | — | — | — | $Al_2O_3$ | 2.0 | 9.0 | 300 | 1.0 | 10.0 | 9 |

Results of evaluation of polishing characteristics for laminated type of amorphous video heads

| | Number of scratches (having a width of at least 0.5 μm) occurring on the surface of a laminated type of amorphous video head after finish polishing | | | Difference in level between different materials (nm) | | Time required to polish the laminated type of amorphous video head by a depth of 1 μm (second.) | Overall evalution |
|---|---|---|---|---|---|---|---|
| | Ceramic part | Amorphous alloy part | Glass part having a low melting point | Between the ceramic part and the amorphous alloy part | Between the ceramic part and the glass part having a low melting point | | |
| Ex. 1 | 0 | 0 | 2 | 10 | 20 | 25 | ○ |
| Ex. 2 | 0 | 0 | 2 | 15 | 25 | 25 | ○ |
| Ex. 3 | 0 | 0 | 2 | 15 | 25 | 25 | ○ |
| Ex. 4 | 0 | 0 | 2 | 15 | 25 | 35 | Δ |
| Ex. 5 | 0 | 0 | 2 | 15 | 25 | 25 | ○ |
| Ex. 6 | 0 | 0 | 2 | 10 | 20 | 30 | ○ |
| Ex. 7 | 0 | 0 | 3 | 15 | 25 | 20 | ○ |
| Ex. 8 | 0 | 0 | 2 | 10 | 20 | 35 | Δ |
| Ex. 9 | 0 | 0 | 3 | 15 | 25 | 20 | ○ |
| Comp. Ex. 1 | 0 | 0 | 2 | 45 | 55 | 40 | X |
| Comp. Ex. 2 | 0 | 3 | 6 | 15 | 25 | 22 | X |
| Comp. Ex. 3 | 0 | 0 | 2 | 10 | 20 | 50 | X |
| Comp. Ex. 4 | 0 | 2 | 5 | 20 | 30 | 20 | X |
| Comp. Ex. 5 | 0 | 0 | 2 | 15 | 25 | 75 | X |
| Comp. Ex. 6 | 0 | 0 | 2 | 10 | 20 | 55 | X |
| Comp. Ex. 7 | 0 | 3 | 6 | 20 | 35 | 15 | X |
| Comp. Ex. 8 | 0 | 0 | 2 | 10 | 20 | 35 | X |
| Comp. Ex. 9 | 0 | 0 | 1 | 10 | 20 | 60 | X |
| Comp. Ex. 10 | 0 | 2 | 4 | 25 | 30 | 15 | X |
| Comp. Ex. 11 | 0 | 3 | 6 | 55 | 65 | 20 | X |
| Comp. Ex. 12 | 0 | 0 | 1 | 10 | 20 | 125 | X |
| Comp. Ex. 13 | 10 | 7 | 12 | 55 | 65 | 20 | X |

What is claimed is:

1. An abrasive tape, for polishing a laminated amorphous head, comprising a flexible substrate and an abrasive layer which is overlaid on said flexible substrate and which contains abrasive grains and a binder, wherein said abrasive grains comprise:

i) first abrasive grains, which have a mean grain diameter falling within the range of 0.07 μm to 0.40 μm and a Mohs hardness falling within the range of 5 to 7.

ii) second abrasive grains, which have a mean grain diameter falling within the range of 0.20 μm to 0.60 μm and a Mohs hardness not lower than 8.5, and iii) fine diamond grains, which have a mean grain diameter falling within the range of 0.50 μm to 3.0 μm.

2. An abrasive tape as defined in claim 1 wherein the proportion of the weight of said fine diamond grains with respect to the total weight of said first abrasive grains and said second abrasive grains falls within the range of 1% to 3%.

3. An abrasive tape as defined in claim 1 wherein the mean grain diameter of said first abrasive grains falls within the range of 0.07 μm to 0.15 μm.

4. An abrasive tape as defined in claim 3 wherein the mean grain diameter of said first abrasive grains falls within the range of 0.10 μm to 0.13 μm.

5. An abrasive tape as defined in claim 1 wherein the mean grain diameter of said second abrasive grains falls within the range of 0.20 μm to 0.40 μm.

6. An abrasive tape as defined in claim 5 wherein the mean grain diameter of said second abrasive grains falls within the range of 0.30 μm to 0.40 μm.

7. An abrasive tape as defined in claim 1 wherein the mean grain diameter of said fine diamond grains falls within the range of 0.5 μm to 2.0 μm.

8. An abrasive tape as defined in claim 1 wherein the proportion of the weight of said first abrasive grains with respect to the total weight of the whole abrasive grains falls within the range of 60% to 80%.

9. An abrasive tape as defined in claim 1 wherein the proportion of the weight of said second abrasive grains with respect to the total weight of the whole abrasive grains falls within the range of 20% to 30%.

10. An abrasive tape as defined in claim 1 wherein the proportion of the weight of said fine diamond grains with respect to the total weight of the whole abrasive grains falls within the range of 1% to 3%.

11. An abrasive tape as defined in claim 1 wherein the ratio of a standard deviation of a distribution of the grain size of said first abrasive grains to a standard deviation of a distribution of the grain size of said second abrasive grains is approximately 1:2.

12. An abrasive tape as defined in claim 1 wherein the proportion of the total weight of said first abrasive grains, said second abrasive grains, and said fine diamond grains with respect to the weight of total solids, which are contained in said abrasive layer comprising the abrasive grains and the binder, falls within the range of 85% to 95%.

13. An abrasive tape as defined in claim 12 wherein the proportion of the total weight of said first abrasive grains, said second abrasive grains, and said fine diamond grains with respect to the weight of total solids, which are contained in said abrasive layer comprising the abrasive grains and the binder, falls within the range of 90% to 95%.

14. An abrasive tape as defined in claim 1 wherein the surface roughness of said abrasive layer falls within the range of 0.046 μm to 0.130 μm.

15. A method for polishing a magnetic head, which comprises the steps of using an abrasive tape as defined in claim 1 during a polishing process on a laminated type of magnetic head, said laminated type of magnetic head being constituted of a non-magnetic substrate, a magnetic material, and a glass bonding agent.

16. A method as defined in claim 15 wherein said polishing process is a finish polishing process.

* * * * *